US005931125A

United States Patent [19]

Valasopoulos

[11] Patent Number: 5,931,125

[45] Date of Patent: Aug. 3, 1999

[54] PISTON INTERNAL COMBUSTION ENGINE VARIABLE ACTION VALVE LIFTER SYSTEM

[76] Inventor: Christos Valasopoulos, 22 Koritsas Str., 10447 Athens, Greece

[21] Appl. No.: 08/718,489

[22] PCT Filed: Dec. 7, 1994

[86] PCT No.: PCT/GR94/00024

§ 371 Date: Sep. 26, 1996

§ 102(e) Date: Sep. 26, 1996

[87] PCT Pub. No.: WO95/33919

PCT Pub. Date: Dec. 14, 1995

[30] Foreign Application Priority Data

Jun. 2, 1994 [DE] Germany ..... 940100266

[51] Int. Cl.[6] ..... F01L 9/02; F01L 13/00

[52] U.S. Cl. ..... 123/90.16; 123/90.48

[58] Field of Search ..... 123/90.12, 90.15, 123/90.16, 90.48

[56] References Cited

U.S. PATENT DOCUMENTS

| | | | |
|---|---|---|---|
| 4,164,917 | 8/1979 | Glasson | 123/90.16 |
| 4,491,098 | 1/1985 | Rotondo | 123/90.16 |
| 4,765,288 | 8/1988 | Linder et al. | 123/90.16 |
| 5,113,811 | 5/1992 | Rembold et al. | 123/90.16 |
| 5,154,143 | 10/1992 | Stutzenberger | 123/90.16 |
| 5,163,389 | 11/1992 | Fujikawa et al. | 123/90.16 |
| 5,193,496 | 3/1993 | Kruger | 123/90.16 |
| 5,255,639 | 10/1993 | Shirey et al. | 123/90.165 |
| 5,555,861 | 9/1996 | Mayr et al. | 123/90.16 |

FOREIGN PATENT DOCUMENTS

| | | |
|---|---|---|
| 292185 | 11/1988 | European Pat. Off. . |
| 911367 | 7/1946 | France . |
| 1529793 | 10/1978 | United Kingdom . |

*Primary Examiner*—Weilun Lo
*Attorney, Agent, or Firm*—Horst M. Kasper

[57] ABSTRACT

Internal combustion engine variable valve lifter system inserted between the contact surface of a conventional in use mechanical or hydraulic type valve lifter, with the respective cam of the camshaft, through which, with the variation of hydraulic means pressure applied on, the inside the formed chamber, located proper elastic balls, is achieved the gradual variation of the respective valve operational characteristics (which variation concerning valves in a cylinder, could be executed in a successive manner) in the medium and lower engine RPM's range.

13 Claims, 9 Drawing Sheets

PISTON INTERNAL COMBUSTION ENGINE VARIABLE ACTION VALVE LIFTER SYSTEM

BACKGROUND OF THE INVENTION

1. Field of the Invention

The invention relates to a system and method that provides the capability to a valve lifter of a piston internal combustion engine (I.C.E.) to act in a variable way on the respective valve, as well as the variation of its timing in general, namely the variation of the valve opening time moment, as well as the variation of the valve opening-valve closing time duration. This variation is executed gradually. With reference to similar valves of the same internal combustion engine cylinder, the gradual variation of the characteristics of one valve to follow at a predetermined time lapse the gradual variation of the characteristics of another valve with the purpose of improving the internal combustion engine performance in the medium and lower operation RPM range.

2. Brief Description of the Background of the Invention Including Prior Art

It is well known that a conventional, presently in use valve lifter, mechanically or hydraulically adjusted, is constantly in contact with the respective cam of a rotating camshaft of an internal combustion engine, and transmits the motion for the opening or closing of the respective valve in a stable manner, with the help of the valve spring.

A further control of the valve motion is achieved according to U.S. Pat. No. 4,765,268 and U.S. Pat. No. 4,689,084 through a valve mechanism, which have the basic idea of controlling the pressure of a hydraulic means securely with the respective valve, wherein the hydraulic means is able to penetrate and come out of a chamber, which chamber is disposed between the respective cam of the internal combustion engine cam-shaft and the upper end of a movable small piston.

The known system requires an electromagnetic valve through which the control of the hydraulic means is achieved and a reservoir for the returning hydraulic means. This reservoir is located outside the electromagnetic valve or is part of the electromagnetic valve construction. A consequence of the above mentioned mechanism is the possibility of changing the operational characteristics of an internal combustion engine valve.

In spite of that, the above mentioned mechanism, has the disadvantage of requiring increased space between the valve end of the respective internal combustion engine cylinder and the corresponding cam, resulting in the need for a new cylinder head design and the increase in production cost.

Another disadvantage is also the fact that the complicated mechanism in conjunction with the mass of its components is creating obviously inertia problems during the engine operation. Finally, the manufacturing cost of the mechanism multiplied by the number of the valves is considerably increasing the production cost of a motor.

SUMMARY OF THE INVENTION

1. Purposes of the Invention

The object of the present invention is to provide for a simple system for increasing and decreasing the pressure of a fluid in a chamber enclosed inside a mechanically or hydraulically adjusted valve lifter already in use in most motor models, manufactured by various companies today, so that no additional cylinder head space is required between the cam and the respective valve lifter that would have resulted in the need for a now cylinder head design.

It is a further object of the present invention to provide for a system which can operate with the variation of the pressure of the oil supplied for internal combustion engine lubrication.

It is still a further object of the present invention to provide for a system which prevents any inertia problem during the operation of the engine and to keep the manufacturing cost similar to the cost of a hydraulic type valve lifter.

These and other objects and advantages of the present invention will be come evident from the description which follows, 2. Brief Description of the Invention The piston internal combustion engine variable action valve lifter system according to the present invention offers an improvement in the efficiency and the torque distribution of the internal combustion engine in the medium and lower operation RPX range, with the gradual reduction of the valve action but also with the successive movement of the valves of the respective cylinder, resulting in a further improvement of the engine torque distribution and, consequently, in fuel economy and in a reduction of polluting emissions.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

DESCRIPTION OF THE INVENTION AND PREFERRED EMBODIMENTS

Figure 1A:
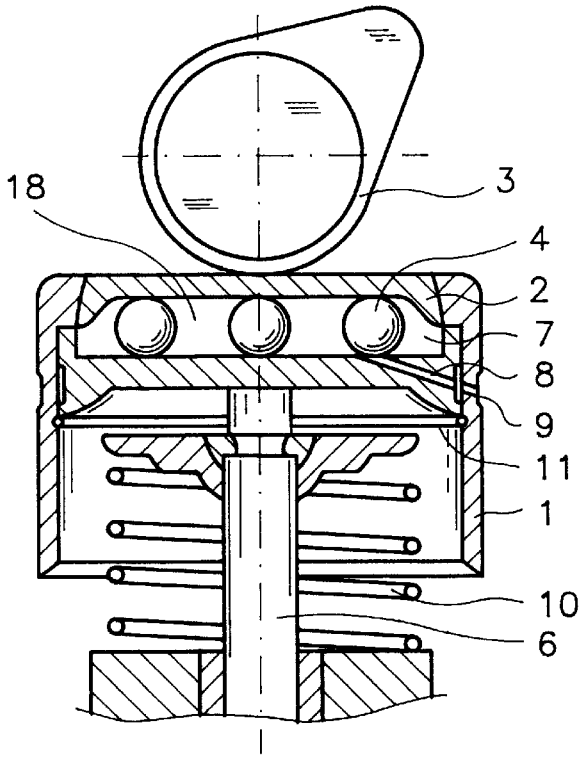
FIG. 1*a* is a schematic sectional view of a first embodiment of a valve lifter.
Figure 1B:
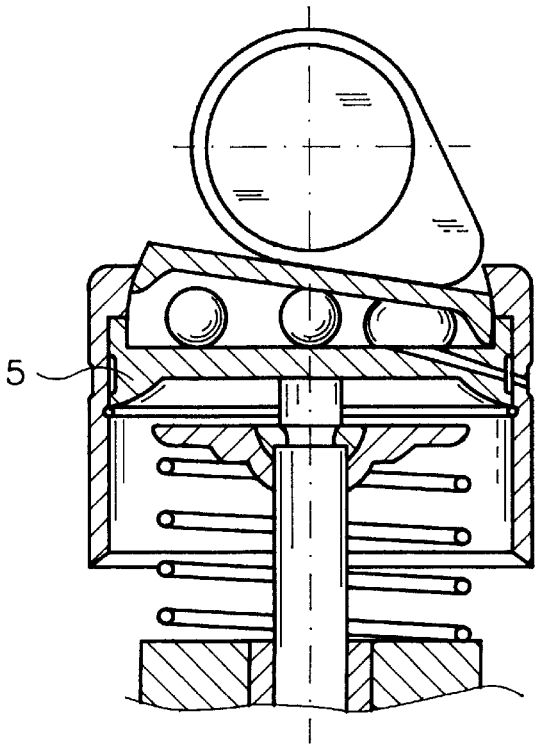
FIG. 1*b* is a schematic sectional view of the first embodiment of the valve lifter with one elastic ball compressed.
Figure 1C:
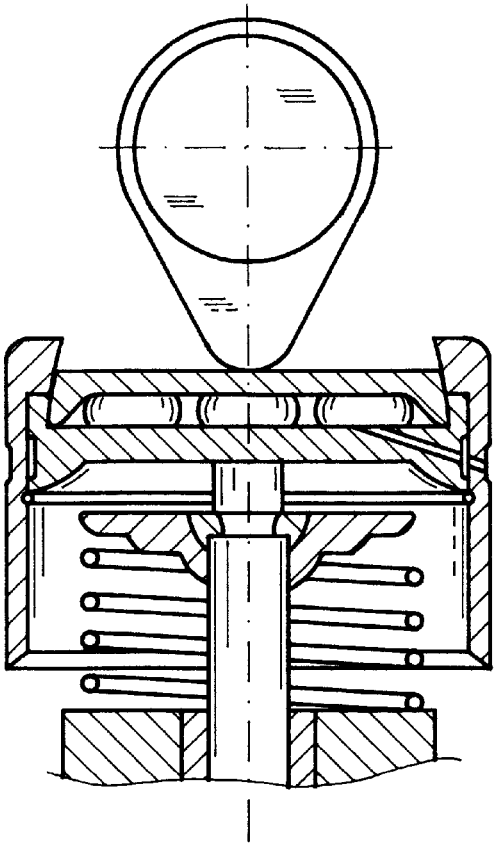
FIG. 1*c* is a schematic sectional view of the first embodiment of the valve lifter with all elastic balls compressed.
Figure 1D:
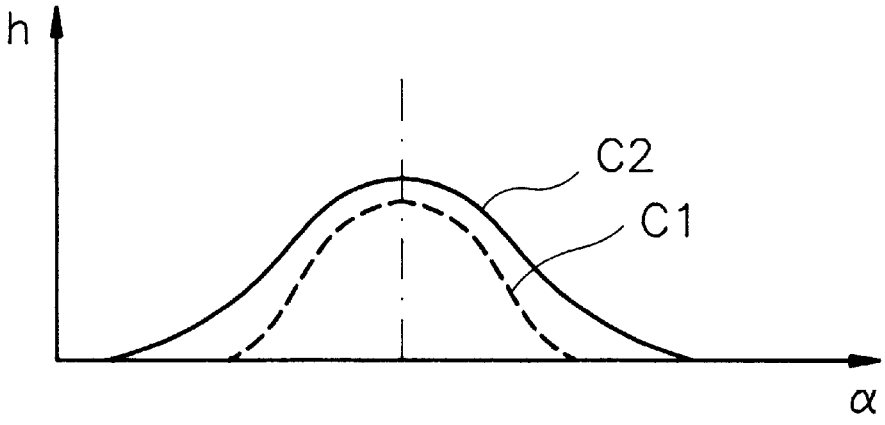
FIG. 1*d* is a schematic diagram illustrating a dependency of a valve lift h relative to an angle (alpha) of rotation of the camshaft for the first embodiment of the valve lifter.
Figure 2A:
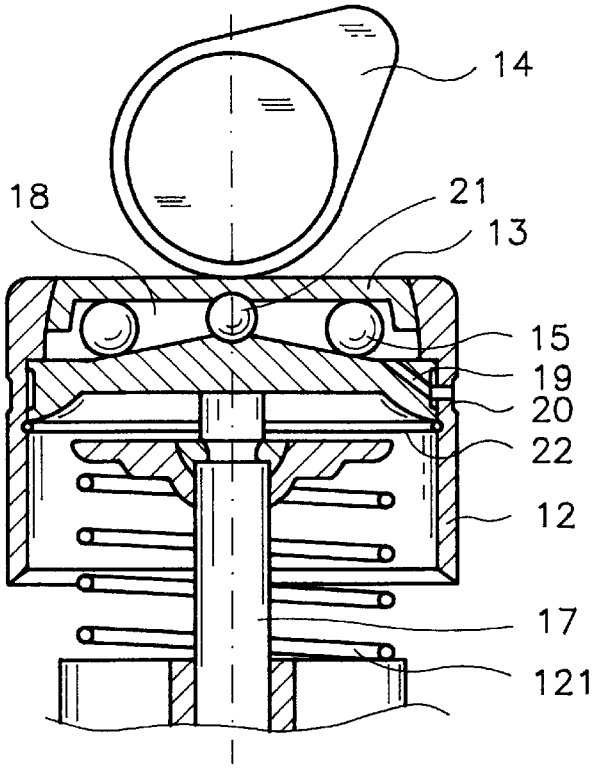
FIG. 2*a* is a schematic sectional view of a second embodiment of a valve lifter with a metallic ball.
Figure 2B:
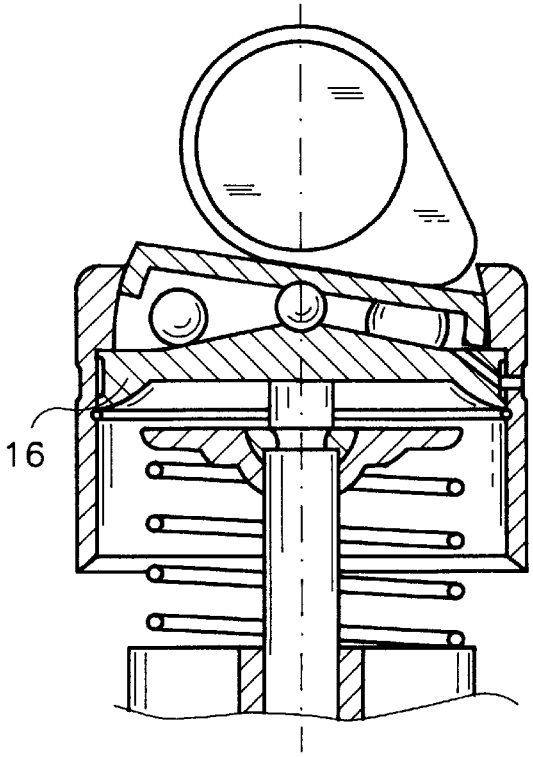
FIG. 2*b* is a schematic sectional view of the second embodiment of the valve lifter with one elastic ball compressed.
Figure 2C:
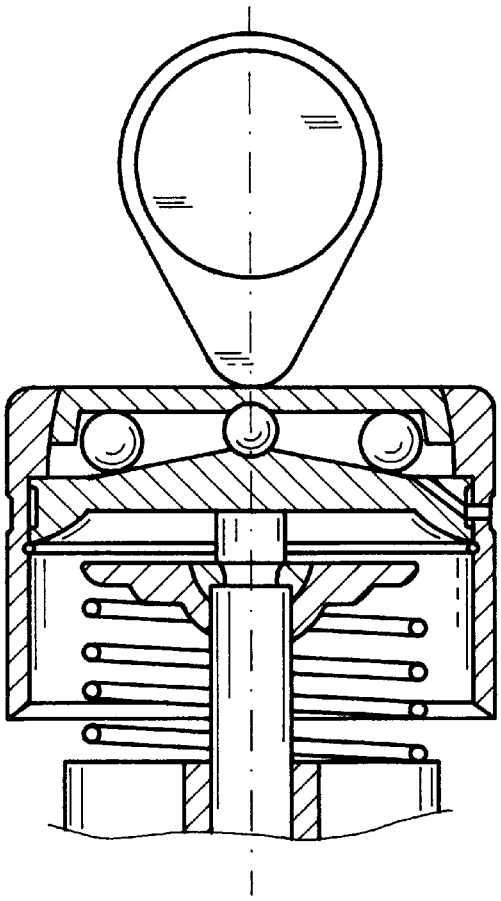
FIG. 2*c* is a schematic sectional view of the second embodiment of the valve lifter when a movable part of the valve lifter is pushed down by a camshaft.
Figure 2D:
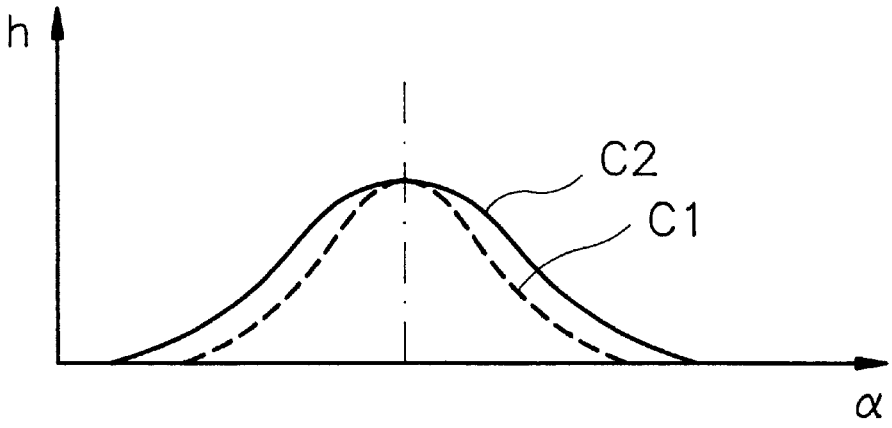
FIG. 2*d* is a schematic diagram illustrating a dependency of a valve lift h relative to an angle (alpha) of rotation of the camshaft for the second embodiment of the valve lifter.

FIG. 1 shows an application of the variable action valve lifter system, which consists of a valve lifter cylinder 1, a movable part 2 of the valve lifter which comes in contact with a respective cam 3, elastic balls 4, and an inner disk 5 in contact with a respective valve 6.

When the system in in contact with the cylindrical base of the cam, it has the shape shown in FIG. 1*a*. As the non-cylindrical part of the cam starts to come in contact with the movable part 2 of the valve lifter, there is produced a tilting and a downward movement of the movable part 2 of the valve lifter, while the elastic balls of this side are depressed up to the point their elasticity is allowing them to be compressed. Up to this point there is no downward movement of the inner disk 5 and consequently of the valve 6. The movement of the valve starts when the first balls are already completely compressed, and continues as the edge of the cam moves towards the center of the valve lifter up to the point when all the balls are compressed and the edge of the cam coincides with the center of the valve lifter. At this point a maximum lifting of the camshaft is achieved.

Continuing the movement of the cam, there occurs a return of the valve lifter into its initial position and, consequently, there occurs the closing of the valve, when the cylindrical base of the cam comes in contact with the valve lifter.

The chamber 7 between the valve lifter cylinder 1 and the movable part 2 of the valve lifter and the inner disk 5, where the elastic balls 4 are located, can be filled with hydraulic means. By varying the pressure of the hydraulic means inside the chamber 7 in any possible way, the elastic behavior of the balls 4 can be influenced and consequently vary the operational characteristics of the system. In particular, by increasing the pressure of the hydraulic means, the elastic behavior of the balls is obviously reduced and, consequently, the balls will give in less when subjected through the valve lifter to the pressure of the respective cam. By further gradually increasing the pressure of the hydraulic means, there can be achieved a situation where the balls will behave practically as nonelastic and, consequently, the whole valve lifter will behave as a conventional valve lifter.

A gradual reduction of the pressure of the hydraulic means results in the reverse procedure. In this way there can be produced a gradual change in the operational characteristics (dependency of a valve lift h relative to an angle (alpha) of rotation of the camshaft) of the valve lifter and, consequently, of the respective valve between an initial $C_1$ and a final $C_2$ state, as shown in the diagram in FIG. 1*d*.

The flowing of the hydraulic means in and out of the chamber 7 is achieved through the duct 8 and the circumferential groove 9. The lock 11 is serving the purpose of securing the whole system after the assembly procedure is finished, The shape of the cam, the elastic characteristics of the balls, the characteristics of the spring of the respective valve, as well as the varying pressure of the hydraulic means, are carefully calculated so that the desired result in achieved each time.

FIGS. 2*a*–2*d* show an application of the variable action valve lifter which consists of a valve lifter cylinder 12, a movable part 13 of the valve lifter, a cam 14, elastic balls 15, an inner disk 16, a valve 17, and a metallic ball 21.

This embodiment differs from the first described embodiment in that a metallic ball 21 is seated in the center of the valve lifter in a respective size spherical recess in the inner disk 16 and the movable part 13 of the valve lifter. The elastic balls 15 are disposed around the metallic ball and inside the chamber 18. The system functions in the same manner as described earlier. Thus, the valve starts to move from the moment the elastic balls cannot be compressed any more. The elastic behavior of these balls 15 can be varied as described above in connection with the elastic balls 4.

The oscillation of the movable part 13 of the valve lifter on the metallic ball 21 results in keeping constant the maximum valve lifting in all cases of varying pressure inside the chamber 18 and the resulting differing elastic behavior of the balls 15, since the maximus valve lifting is defined by the metallic ball, whose size is unchangeable. This fact is clearly shown in the graph of FIG. 2*d*, where the initial operational state $C_1$ and the final operational state $C_2$ of the respective valve in shown.

Figure 3A:
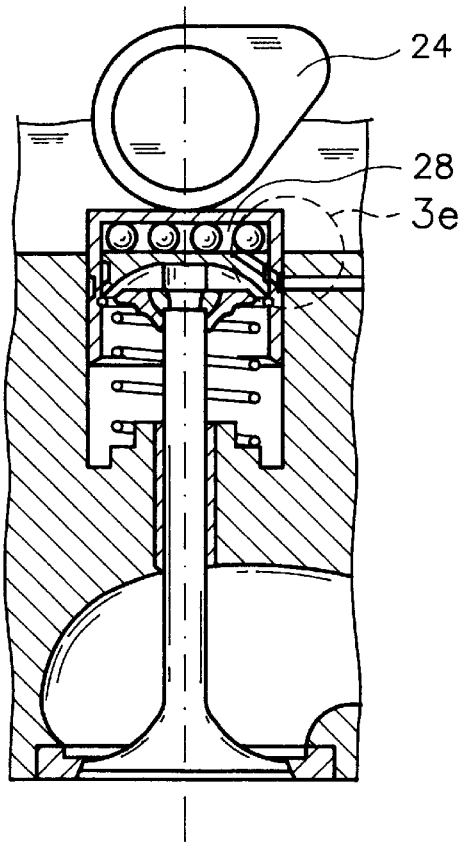
FIG. 3*a* is a schematic sectional view of a third embodiment of a valve lifter when no pressure is exerted onto the valve lifter.
Figure 3E:
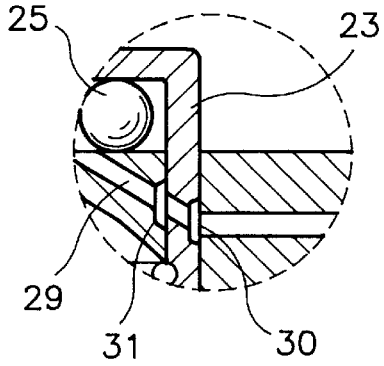
FIG. 3*e* is an enlarged partial sectional view of the valve lifter according to FIG. 3*a;*
Figure 3B:
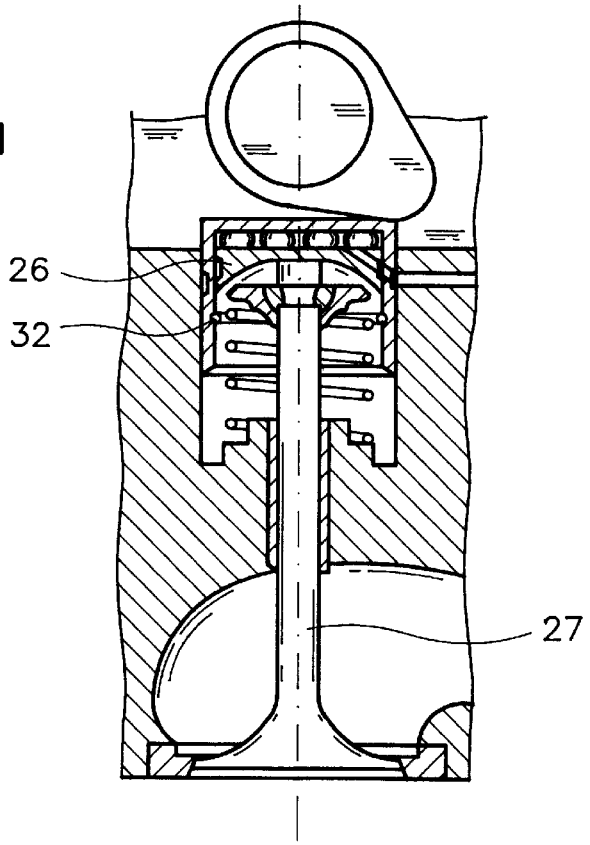
FIG. 3*b* is a schematic sectional view of the third embodiment of the valve lifter some pressure is exerted onto the valve lifter by the camshaft.
Figure 3C:
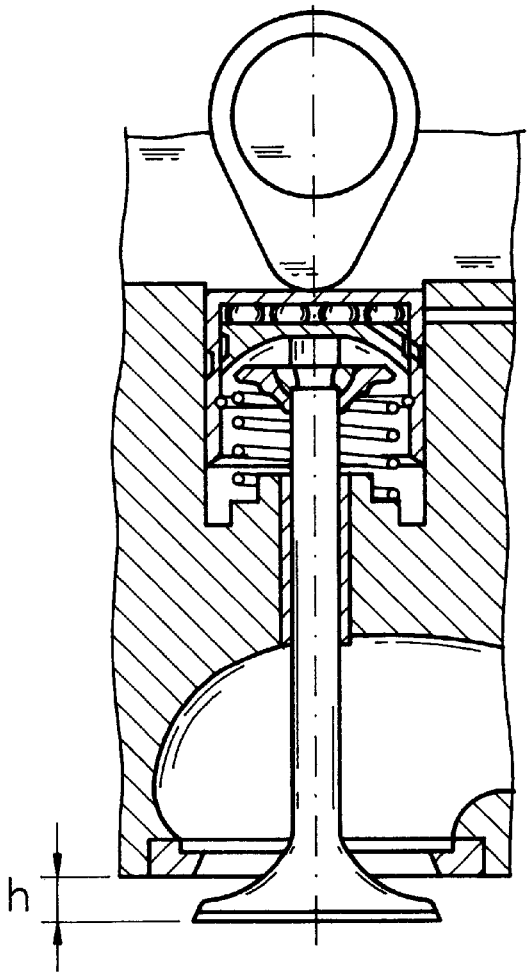
FIG. 3*c* is a schematic sectional view of the third embodiment of the valve lifter when a maximum pressure is exerted onto the valve lifter by the camshaft.
Figure 3D:
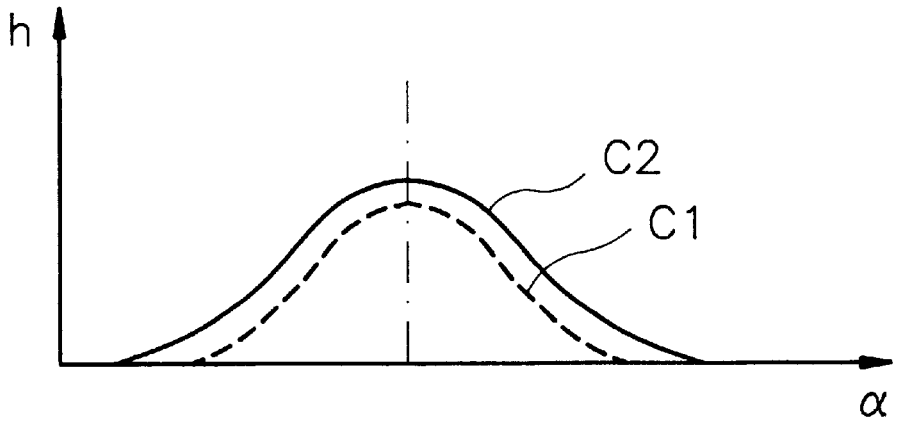
FIG. 3*d* is a schematic diagram illustrating a dependency of a valve lift h relative to an angle (alpha) of rotation of the camshaft for the third embodiment of the valve lifter.

FIGS. 3*a*–3*e* show a further embodiment of the variable action valve lifter system, where the valve lifter is a solid element without the presence of a movable part. During the movement of the cam, the whole valve lifter 23 moves downwards and compresses all of the elastics balls 25. The movement of the inner disk 26 and, consequently, the respective valve 27 starts only when the elastic balls are compressed to such a degree that their resistance to a further compression in exceeding the resistance of the respective valve spring. The variation of the pressure of the hydraulic means inside the chamber 28 has a direct effect on the variation of the elastic behavior of the balls 25 and, consequently, on the variation of the operational characteristics of the system in the same way as set forth above in regard to the embodiments shown in FIGS. 1*a*–1*d* and 2*a*–2*e*. The flowing of the hydraulic means inside the chamber 28 (FIG. 3*a*) is achieved through the duct 29 and the circumferential groove 31 curved on the inner disk, and the circumferential groove 30 disposed on the valve lifter, as shown in detail in FIG. 3*e*. FIG. 3*d* shows the initial operational state $C_1$ and the final operational state $C_2$ of the valve, achieved with the above mentioned system.

Figure 4B:
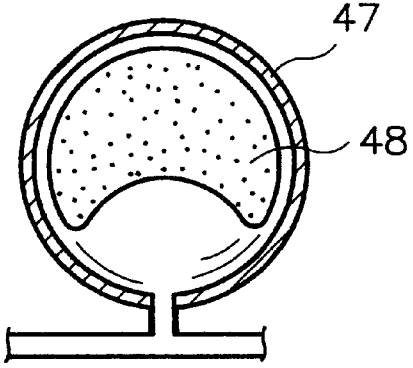
FIG. 4*b* is a schematic sectional view of a pressure vessel.
Figure 4A:
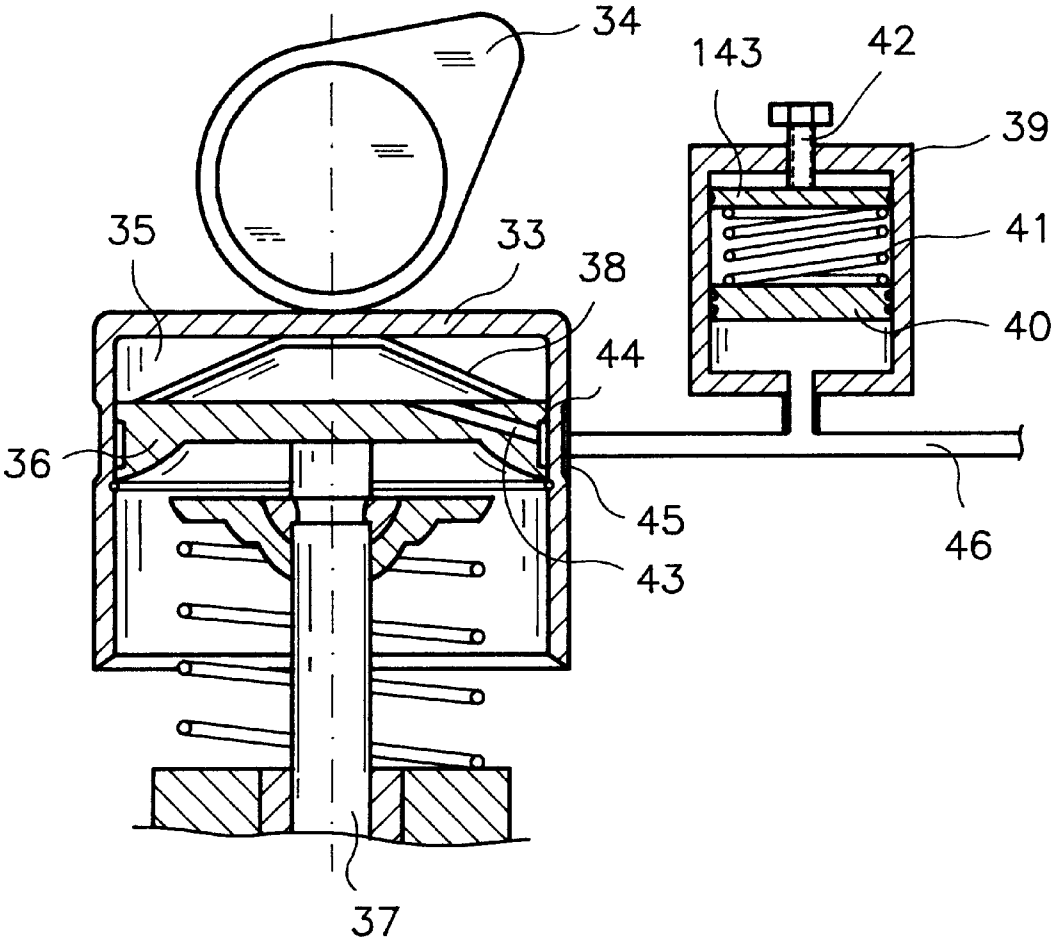
FIG. 4*a* is a schematic sectional view of a fourth embodiment of a valve lifter.

FIG. 4*a* shows another embodiment of the variable action valve lifter system consisting of a valve lifter cylinder 33, an inner disk 36, a chamber 35 disposed between the valve lifter cylinder 33 and the inner disk 36, a cam 34, a valve 37, a spring washer 38, a small cylinder 39, a piston 40, a cylinder spring 41, an adjusting screw 42, and a washer 143.

There are no elastic balls in the chamber 35. The whole chamber is flooded with hydraulic means whose pressure can change. The flooding of this chamber is achieved through a duct 46, a circumferential groove 45 on the valve lifter and a circumferential groove 44 on the inner disk and the duct 43.

When the non-cylindrical part of the cam starts to come in contact with the valve lifter cylinder 33, the valve lifter gives in forcing the hydraulic means out of the chamber 35 through the ducts 43 and 46 into the small cylinder 39. In this way the piston 40 is forced by the hydraulic means to move upwardly. The travel of this movement depends, obviously, on the characteristics of the cylinder spring 41. When the cylinder spring is completely compressed, it does no longer allow the flowing of the hydraulic means in the small cylinder 39 and, consequently, the further escape of hydraulic oil from the chamber 35 of the valve lifter. In this way, while up to this point only the valve lifter cylinder 33 was moving based on the hydraulic means inside the chamber 35, which has no escape route, the inner disk 36 is pushed and consequently also the respective valve. As the edge of the cam passes the center of the valve lifter and moves away, the valve lifter cylinder 33 is free to move and is moving upwards with the help of the hydraulic means which is forced out of the small cylinder 39 with the cylinder spring 41 and the piston 40 and into the chamber 35.

It is clear from the above that the start of the valve movement as well as the degree of the maximum lifting of the valve, depends on the elastic characteristic of the cylinder spring 41, which defines the amount of hydraulic means that is allowed to come out of the chamber 35 and enter the small cylinder 39. Consequently, a control of the elastic behavior of the cylinder spring 41 would allow the control of the operational characteristics of the valve.

This control is made possible as follows:

By increasing the pressure of the hydraulic means inside the duct 46, a flow of hydraulic means inside the small cylinder 39 pushes the piston 40 and compresses the cylinder spring 41 in a length proportional to its pressure. Obviously in this way the allowed compression of the cylinder spring is reduced as a result of the flow of hydraulic means inside the small cylinder 39, which is forced out from the chamber 35 based on the pressure from the cam action. This fact means a smaller self-travel for the valve lifter cylinder 33, an earlier opening of the valve, as well as an increase in the maximum cam lifting. With a further increase in the pressure of the hydraulic means, an even greater compression of the cylinder spring 41 can be achieved up to the point of complete compression. At this point, of course, the possibility for no further spring compression means that hydraulic means cannot escape from the chamber 35 when the valve lifter is pushed by the cam, and consequently the behavior of the valve lifter is similar to a conventional one.

A gradual reduction of the pressure of the hydraulic means results in a reverse procedure.

An initial adjustment of the prestressing of the cylinder spring 41 is possible by means of the adjusting screw 42 and the washer 143. The profile of the cam, the elastic characteristics of the cylinder spring 41, and the pressure of the hydraulic means are properly calculated so that the desired result is achieved every time.

It is pointed out that the spring washer 38 is simply securing the continuous contact of the valve lifter with the respective valve, even when the motor is not running, and does not play any other role in the whole operation of the system.

The width of the circumferential grooves 44 and 45 is also properly calculated such that the ducts 43 and 46 are constantly in contact in every position of the valve lifter during its travel in relation to the inner disk 36.

An important modification of the above mentioned system in the possibility to achieve the change in the compression of the cylinder spring 41, aiming each time in varying its elastic behavior, not through the variation of the pressure of the hydraulic means, as described previously, but through a proper adjusting screw, located on top of the small cylinder 39, such as for example the adjusting screw 42 shown in FIG. 4*a*. Said adjusting screw 42 pushes and compresses the cylinder spring 41 with the help of a washer, such as for example the washer 143, when said screw is moved gradually downwardly by an independent control means, such as for example an electric motor, or releases the cylinder spring 41, when said screw is moved upwardly A modification of the system just previously described is shown in FIG. 4*b*, where instead of the small cylinder 39 there is a pressure vessel 47 and in place of the cylinder spring 41 there is an elastic membrane 48 filled with compressed air. The operation of this system is similar to the operation of the system just previously described.

Figure 6:
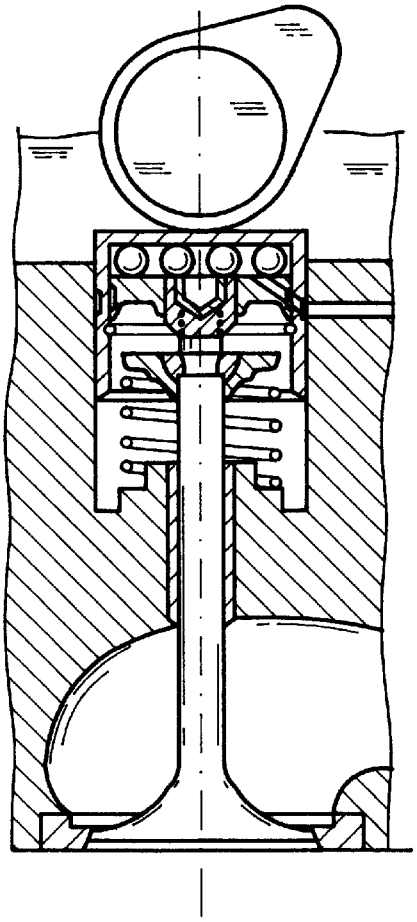
FIG. 6 is a schematic sectional view of a fifth embodiment of the valve lifter.

FIG. 6 shows an embodiment of the variable action valve lifter system, which is described in connection with the embodiment of FIGS. 2*a*–2*d* and FIGS. 3*a*–3*e*, with the only difference being that the valve lifter is of a hydraulic type and not of a mechanical type.

Figure 5:
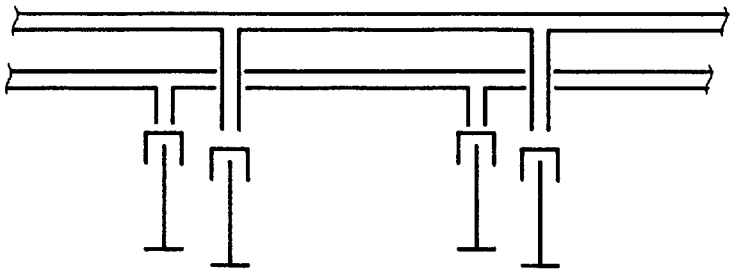
FIG. 5 is a schematic view of hydraulic means supply ducts.

FIG. 5 is a schematic view showing the use of two hydraulic means supply ducts instead of one. Two ducts can be used in case two inlet valves and two outlet valves are employed in every cylinder. The first duct supplies the hydraulic means to the valve lifters of a first inlet valve and of a first outlet valve, and the second duct supplies the hydraulic means to the valve lifters of a second inlet valve and a second outlet valve of the cylinder. Every variation in the pressure inside the ducts produces a variation of the characteristics of the respective valves with which it is connected, according to what was described so far. In addition, if the variation of the hydraulic means pressure inside one duct is executed with a properly calculated delay relative to the respective hydraulic means pressure variation in the other duct, the change of the operational successive characteristics of the similar valves is achieved in each cylinder with the obvious result of an even smoother torque distribution in the medium and lower rpm operational range of the motor.

Figure 7:
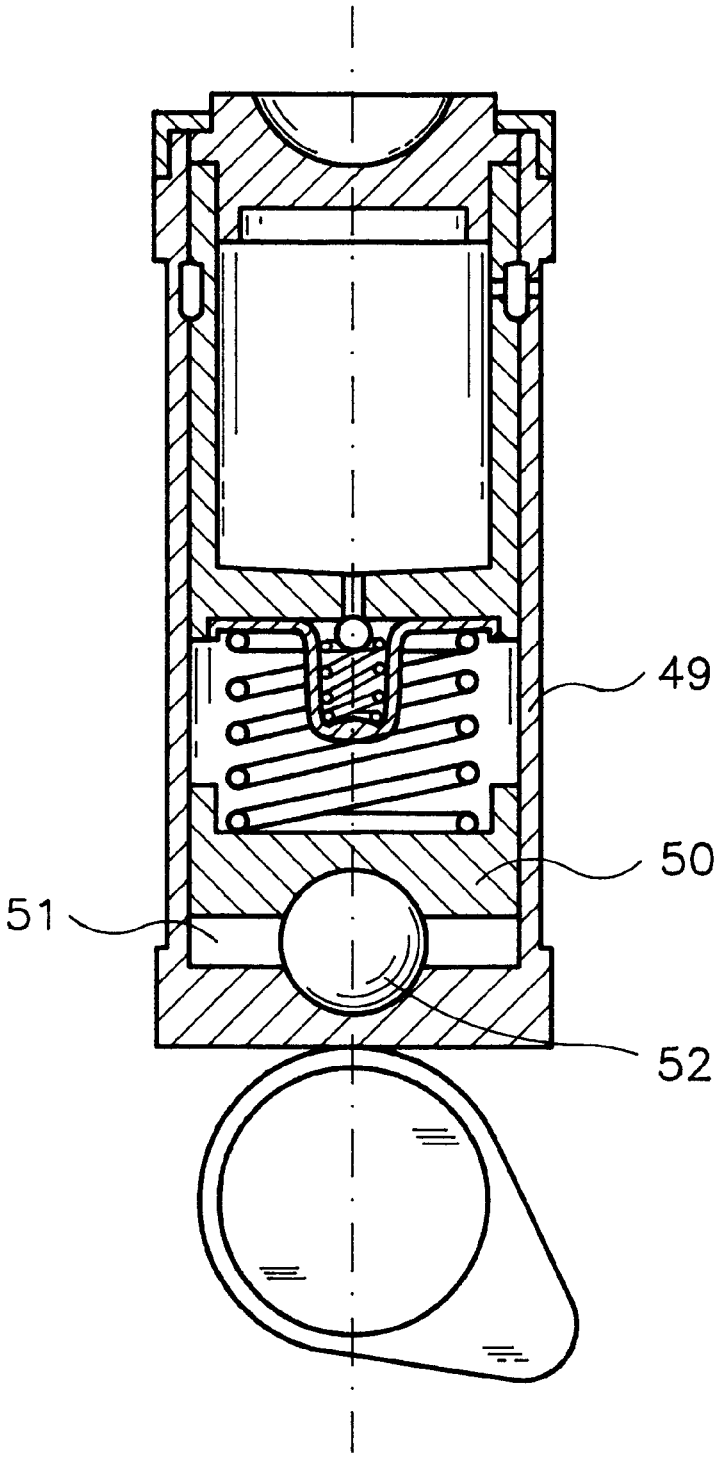
FIG. 7 is a schematic sectional view of a sixth embodiment of a valve lifter.

FIG. 7 shows an embodiment of the variable action valve lifter system in case of side camshafts. The variable action valve system consists in this case of a respective valve lifter 49 of the hydraulic type an inner disk 50, a chamber 51 disposed between the valve lifter 49 and the inner disk 50, and an elastic ball 52. A variation of the hydraulic means pressure inside the chamber 51 produces the same results as the results achieved with the previously described embodiments.

It will be understood that each of the elements described above, or two or more together, may also find a useful application in other methods and types of valve lifter systems differing from the types described above.

While the invention has been illustrated and described as embodied in the context of a variable action valve lifter system for a piston internal combustion engine, it is not intended to be limited to the details shown, since the various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A variable action valve lifter system comprising:

an internal combustion engine camshaft having at least one cam;

a valve having a stem and coordinated to said cam;

a spring coordinated to said valve and acting on said valve;

a valve lifter cylinder with a contact bottom part being in continuous contact with said cam;

an inner disk inserted in the valve lifter cylinder and being in contact with an end of the stem of said valve and forming a chamber together with the valve lifter cylinder with the contact bottom part;

elastic means formed by balls inserted in the chamber and squeezed between the contact bottom part and the inner disk, wherein the valve lifter cylinder, the inner disk, and the elastic means are placed in a cylindrical borehole, wherein said valve is being opened during rotation of the camshaft when a sum of a force exerted by distortion of the elastic means and a force of hydraulic pressure of a hydraulic medium present in the chamber and acting on the contact bottom part exceed a force of said spring, and wherein a valve lift of said valve depends on a degree of distortion of the elastic means and on said hydraulic pressure of the hydraulic medium supplied to the chamber, and wherein a characteristic of an angle of rotation of the camshaft-dependent valve lift is changed by modifying the hydraulic pressure and the elasticity of the elastic means.

2. The variable action valve lifter system according to claim 1, further comprising a first hydraulic medium supply duct, wherein the contact bottom part of the valve lifter cylinder is fixedly attached to the valve lifter cylinder, wherein the inner disk is movable, sliding inside the valve lifter cylinder, and wherein an elastic behavior of the elastic means changes by varying the hydraulic pressure of the hydraulic medium supplied via the first hydraulic medium supply duct to the chamber formed between the inner disk and the contact bottom part of the valve lifter cylinder.

3. The variable action valve lifter system, according to claim 2, further comprising an additional chamber;

a second hydraulic medium supply duct connecting the additional chamber and the first hydraulic medium supply duct, wherein the hydraulic pressure in the second hydraulic medium supply duct is variable according to a pressure variation in the first hydraulic medium supply duct, according to a properly calculated time lapse.

4. The variable action valve lifter system according to claim 2, wherein an action of said system results in a gradual variation of operational characteristics of a respective valve, for achieving a gradual increase and smooth motor torque distribution in a medium and lower operational RPM range.

5. The variable action valve lifter system according to claim 1, wherein a metallic ball is seated in a spherical recess made in a center of the inner disk, and wherein the metallic ball defines an oscillation point of the movable contact bottom part of said valve lifter.

6. The variable action valve lifter system according to claim 1, wherein the valve lifter cylinder and the contact bottom part form a uniform piece.

7. The variable action valve lifter system according to claim 1, wherein motor lubrication oil is used as the hydraulic medium.

8. The variable action valve lifter system according to claim 1, wherein the hydraulic medium is supplied to the chamber through a first hydraulic means supply duct connected with a circumferential groove formed in an outer surface of the valve lifter cylinder and a duct formed in the inner disk fitted in the valve lifter cylinder.

9. The variable action valve lifter system according to claim 1, wherein one of the balls is a metallic ball disposed in a middle of the inner ring, and wherein the contact bottom part of the valve lifter cylinder is movably disposed in a bottom of the valve lifter cylinder, and wherein the metallic ball defines an oscillation point of the contact bottom part.

10. The variable action valve lifter system according to claim 1, further comprising a recess formed in a center of the inner disk;

a metallic ball disposed in a center of the chamber and seated in the recess, and wherein the balls are surrounding the metallic ball.

11. The variable action valve lifter system according to claim 1, wherein the valve lifter cylinder is uniform and without a presence of a movable part;

wherein the valve lifter cylinder is engaged by a movement of the cam and the valve lifter cylinder moves downward compressing the balls;

wherein in came a resistance to further compression of the elastic balls is larger than a resistance to further compression of the spring, then the balls are compressed to such a degree that a movement of the inner disk is started and thereby a movement of the stem of the valve.

12. The variable action valve lifter system according to claim 1, wherein the force of the hydraulic pressure of the hydraulic medium in the chamber varies an elastic behavior of the balls for modifying the operational characteristics of the valve lifter system.

13. The variable action valve lifter system according to claim 1, further comprising a duct connected to the chamber for feeding the hydraulic medium into the chamber;

a circumferential groove disposed at the valve lifter cylinder and connected to the duct.

* * * * *

UNITED STATES PATENT AND TRADEMARK OFFICE

CERTIFICATE OF CORRECTION

PATENT NO : 5,931,125

DATED : August 3, 1999

INVENTOR(S): Christos Valasopoulos

It is certified that error appears in the above-identified patent and that said Letters Patent is hereby corrected as shown below:

- Column 2, line 18:

delete "RPX" and insert --RPM---

- Column 2, line 49:

delete "camshaft" and insert --cam--

- Column 3, line 14:

delete "FIG. 1" and insert --FIG. 1a--

- Column 3, line 33:

delete "camshaft" and insert --cam--

UNITED STATES PATENT AND TRADEMARK OFFICE

CERTIFICATE OF CORRECTION

PATENT NO. : 5,931,125
DATED : August 3, 1999
INVENTOR(S) : Christos Valasopoulos It is certified that error appears in the above-identified patent and that said Letters Patent is hereby corrected as shown below:

Column 4, line 32:
delete "maximus" and insert --maximum--.

Signed and Sealed this

Twenty-sixth Day of December, 2000

*Attest:*

Q. TODD DICKINSON

*Attesting Officer*

*Director of Patents and Trademarks*